United States Patent [19]

Bertsch et al.

[11] Patent Number: 4,603,670

[45] Date of Patent: Aug. 5, 1986

[54] METHOD OF AND DEVICE FOR LAMBDA-REGULATION OF FUEL MIXTURE FOR AN INTERNAL COMBUSTION ENGINE

[75] Inventors: Richard Bertsch, Asperg; Dieter Günther, Murr; Hans Schnürle, Walheim; Ulrich Steinbrenner, Stuttgart, all of Fed. Rep. of Germany

[73] Assignee: Robert Bosch GmbH, Stuttgart, Fed. Rep. of Germany

[21] Appl. No.: 627,742

[22] Filed: Jul. 5, 1984

[30] Foreign Application Priority Data

Jul. 28, 1983 [DE] Fed. Rep. of Germany ..... 3327156

[51] Int. Cl.[4] ..... F02D 41/14

[52] U.S. Cl. ..... 123/440; 123/489

[58] Field of Search ..... 123/440, 489, 589; 60/276

[56] References Cited

U.S. PATENT DOCUMENTS

| | | | |
|---|---|---|---|
| 3,782,347 | 1/1974 | Schmidt et al. | 123/440 |
| 3,831,564 | 8/1974 | Schmidt et al. | 123/440 |
| 4,170,040 | 10/1979 | Leblanc et al. | 123/440 |
| 4,290,400 | 9/1981 | Pomerantz | 123/440 |
| 4,364,356 | 12/1982 | Gerhold | 123/440 |

*Primary Examiner*—Andrew M. Dolinar

*Attorney, Agent, or Firm*—Michael J. Striker

[57] ABSTRACT

A method of and a device for regulating air-fuel ratio of an internal combustion engine includes an oxygen or lambda probe and a signal processing unit connected to the lambda probe. The change-overs of the lambda signal at the output of the lambda probe are compared with a succession of adjustable first time intervals $t_1$ and, when no change-over is detected during the first time interval, the output signal from the signal processing unit which controls the air-fuel ratio is abruptly changed in a jump. To avoid overshoot of the output control signal, there is provided a resetting unit by means of which the jump of the control signal is reversed when the change-over of the lambda signal occurs in an additional monitoring time interval $t_2$ following the first monitoring time interval $t_1$.

17 Claims, 10 Drawing Figures

METHOD OF AND DEVICE FOR LAMBDA-REGULATION OF FUEL MIXTURE FOR AN INTERNAL COMBUSTION ENGINE

BACKGROUND OF THE INVENTION

The invention relates in general to regulation of the air-fuel ratio in an internal combustion engine, and in particular to a method of and device for regulating the air-fuel ratio by using a lambda probe (or oxygen probe) which is sensitive to the proportion of oxygen in the combusted fuel mixture. The probe delivers practically a binary signal in the sense that for a rich mixture a "high" lambda signal (corresponding to about one volt), and for a weak mixture a "low" Lambda signal (corresponding to about 50 millivolts) is generated at the output of the probe. The switch-over point of the lambda probe in a first approximation corresponds to a unitary lambda value (lambda=1) at which the air-fuel ratio corresponds exactly to the stochiometric value.

The output lambda signal from the oxygen probe is applied to a regulating device which controls via setting members the air-fuel ratio. If the oxygen or lambda probe detects a rich mixture then the regulating device controls the fuel supply so that after a certain delay which is determined by the propogation time of the air-fuel mixture through the engine, a weaker fuel mixture is indicated by the lambda signal at the output of the probe. As a consequence, the fuel metering system of the engine serves again to produce a richer mixture until the oxygen probe indicates an excessively rich mixture. In this building up condition the output lambda signal of the oxygen probe continuously fluctuates between the "high" and "low" states.

In the known lambda regulators of this kind, for processing this fluctuating output signal of the oxygen probe, a rotary speed adaptive PI regulator has been used among other measures. The values of the P- and I-components of this regulator cannot for various reasons be selected arbitrarily. The reason for this limitation resides in the possibility of an excessive exhaust gas emission due to dynamic mismatch resulting from the above-mentioned transmission or propogation time of the air-fuel mixture through the engine. On the other hand, the run of the engine would exhibit even in a stationary operation only unsatisfactory results.

In order to avoid the above disadvantages and to improve sluggishness of the regulating arrangement, in the German publication DE-OS No. 22 06 276 a lambda regulating device has been disclosed in which the time interval between two change-over processes of the lambda signal at the output of the probe is detected and after the expiration of a preset time interval in which no change-over of the output signal occurs, the device is switched over to another integration time constant, particularly to a lower time constant of the integration regulator.

This known regulating device has proven satisfactory in practice, although an optimum behavior of the power output of the internal combustion engine with respect to the exhaust gas emission has not been achieved. In particular, in different operational situations of the engine it may happen that this known regulating device has an excessively sluggish behavior causing impurity of the exhaust gas and unequality of the driving behavior.

SUMMARY OF THE INVENTION

It is therefore a general object of the this invention to overcome the aforementioned disadvantages.

More particularly it is an object of this invention to provide an improved dynamic behavior of the lambda regulator, particularly in the event of a mismatch due to an inaccurate idling adjustment so that a lower exhaust gas polution or an improvement of the overall conversion quality of the catalyser built-in in the exhaust gas system, is obtained.

Another object of this invention is to insure that an over-shoot of the regulating device due to the action of a resetting device is compensated.

An additional object of this invention is to provide such an improved regulating device which is suitable for using both an analog and a digital signal processing unit connected to the output of the lambda or oxygen probe.

In keeping with these objects and others which will become apparently after, one feature of the invention resides, in a method of regulating air-fuel ratio in an internal combustion engine including an oxygen probe for delivering, during a measuring period, a lambda signal indicative of proportion of oxygen in exhaust gas, and a signal processing unit connected to the oxygen probe for processing the lambda signal according to an operational characteristic, and delivering a control signal at its output, the signal processing unit including means for adjusting, between at least two change-overs of the lambda signal and after the expiration of an adjustable time period, the operational characteristic of the signal processing unit in dependency on operational parameters of the engine such as load, rotary speed, temperature and the like, in the steps of detecting during periodic monitoring time intervals the occurrence of unchanged lambda signal and, after the expiration of a monitoring interval and in response to the detected occurrence of the unchanged lambda signal, changing suddenly the magnitude of the control signal at the output of the signal processing unit.

The novel features which are considered as characteristic for the invention are set forth in particular in the appended claims. The invention itself however both as to its construction and its method of operation together with additional objects and advantages thereof will be best understood from the following description of specific embodiments when read in connection with the accompanying drawing.

DESCRIPTION OF PREFERRED EMBODIMENTS

Figure 1:
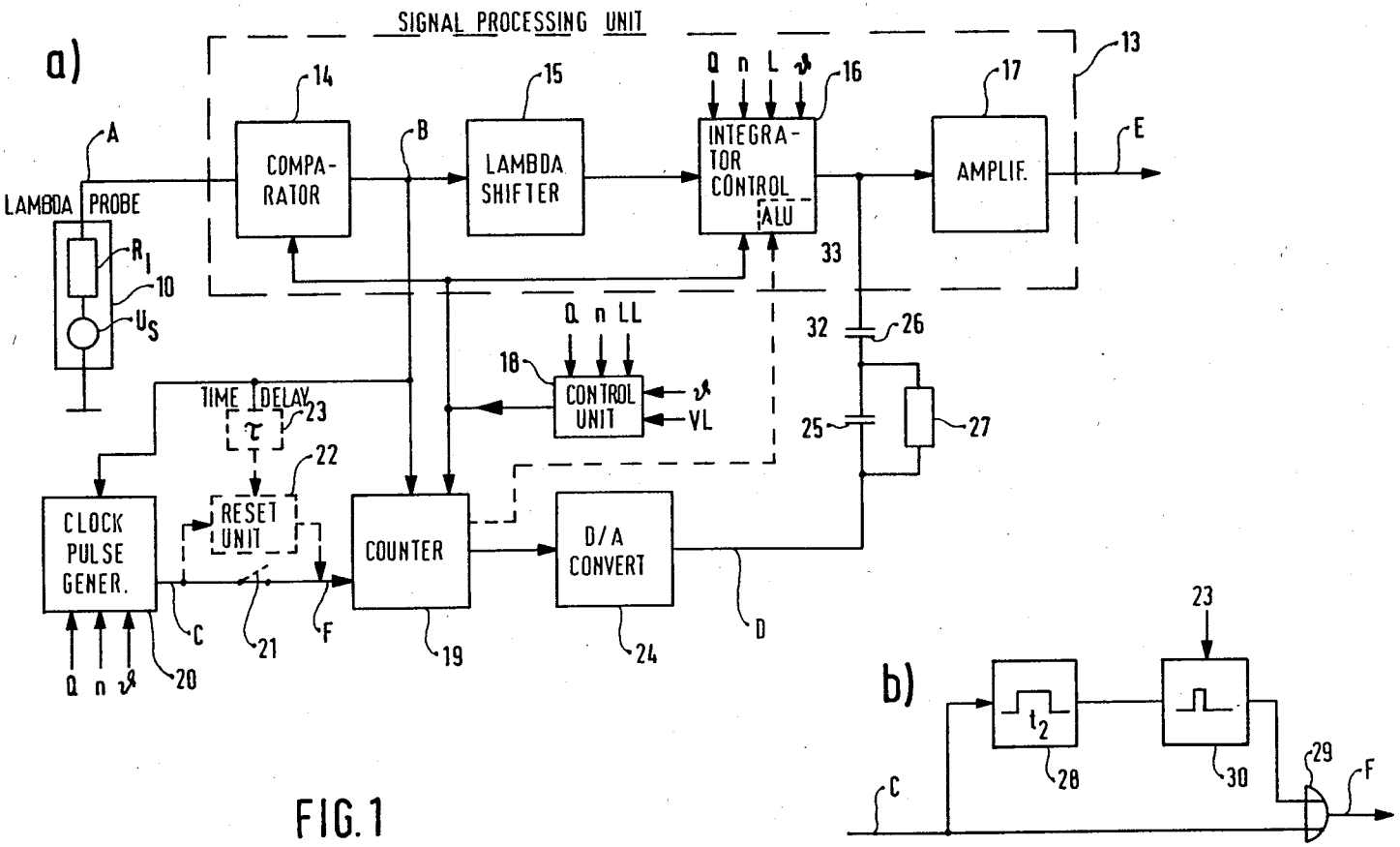
FIG. 1A shows in a block circuit diagram an embodiment of a device for lambda regulation according to this invention.
FIG. 1B shows in greater detail the resetting for preventing overshoot in the signal processing unit.

Referring to FIG. 1*a*, reference numeral 10 involves an oxygen- or lambda probe illustrated as an equivalent circuit diagram consisting of a voltage source $U_s$ and a resistor $R_i$. The lambda signal at the output A of the lambda probe 10 is applied to a signal processing unit 13 consisting of a series connection of a comparator 14, a lambda shift circuit 15, an integrator control circuit 16 and an amplifier 17. The output signal E of the amplifier of the signal processing unit serves for correcting the setting of a setting member in an adjustment system 34 for the air-fuel ratio. The integrator control circuit 16 has a plurality of inputs for receiving signals corresponding to different operational parameters of the internal combustion engine, such as for example the momentary charge Q of fuel or air, rotary speed n, load L or temperature d, as indicated by arrows. In addition, the integrator control circuit 16 is connected via a data bus to the comparator 14, to a control unit 18 and to a counter 19.

The control unit 18 is supplied with signals corresponding to the aforementioned operational parameters Q, n, d of the engine and with additional signals corresponding to idling speed LL or full load VL. The output signal B from the comparator 14 is applied not only to the lambda shifter 15 but also to the counter 19 and to a clock pulse generator 20. The clock pulse generator 20 generates clock pulses in response to different operational parameters of the engine such as for example Q, n, d, as indicated by arrows. The output signal C from the clock pulse generator pulse 20 can be connected to the counter 19 via a switch 21 which is bridged by a resetting unit 22, as indicated by dashed lines. Accordingly, the clock signal C after opening the switch 21 is supplied to the reset unit 22 which delivers a resetting signal F to the counter 19. Another input of the reset unit 22 is connected via a time delay circuit 23 to the output B of the comparator 14.

The output signals from counter 19 are supplied to a digital/analog convertor 24 whose analog output signal D is applied via RC circuit 27, 25 and a series connected capacitor 26 to the input of the amplifier 17 in the signal processing unit.

An example of a more detailed construction of the resetting unit 22 is shown in FIG. 1*b*. The output signal C from the clock generator 20 is applied to a monostable multivibrator 28 whose loading time is set to a time period $t_2$. At the same time, the clock pulse C is applied to an input of an OR gate 29. The monostable multivibrator 28 controls the enable input of another monostable multivibrator 30. The control input of the multivibrator 30 is connected to the time delay circuit 23 which as mentioned before, is connected to the output B of the comparator 14. The output signal of the second monostable multivibrator 30 is applied to the other input of the OR gate 29 and to the output F from the OR gate is applied to the control input of the counter 19. When the switch 21 is in its closed position shunting the resetting unit 22, the latter becomes inoperative and the clock signal C is supplied directly to the counting input of counter 19.

The operation of the regulating device of this invention will be explained in connection with time diagrams of FIG. 2.

Figure 2:
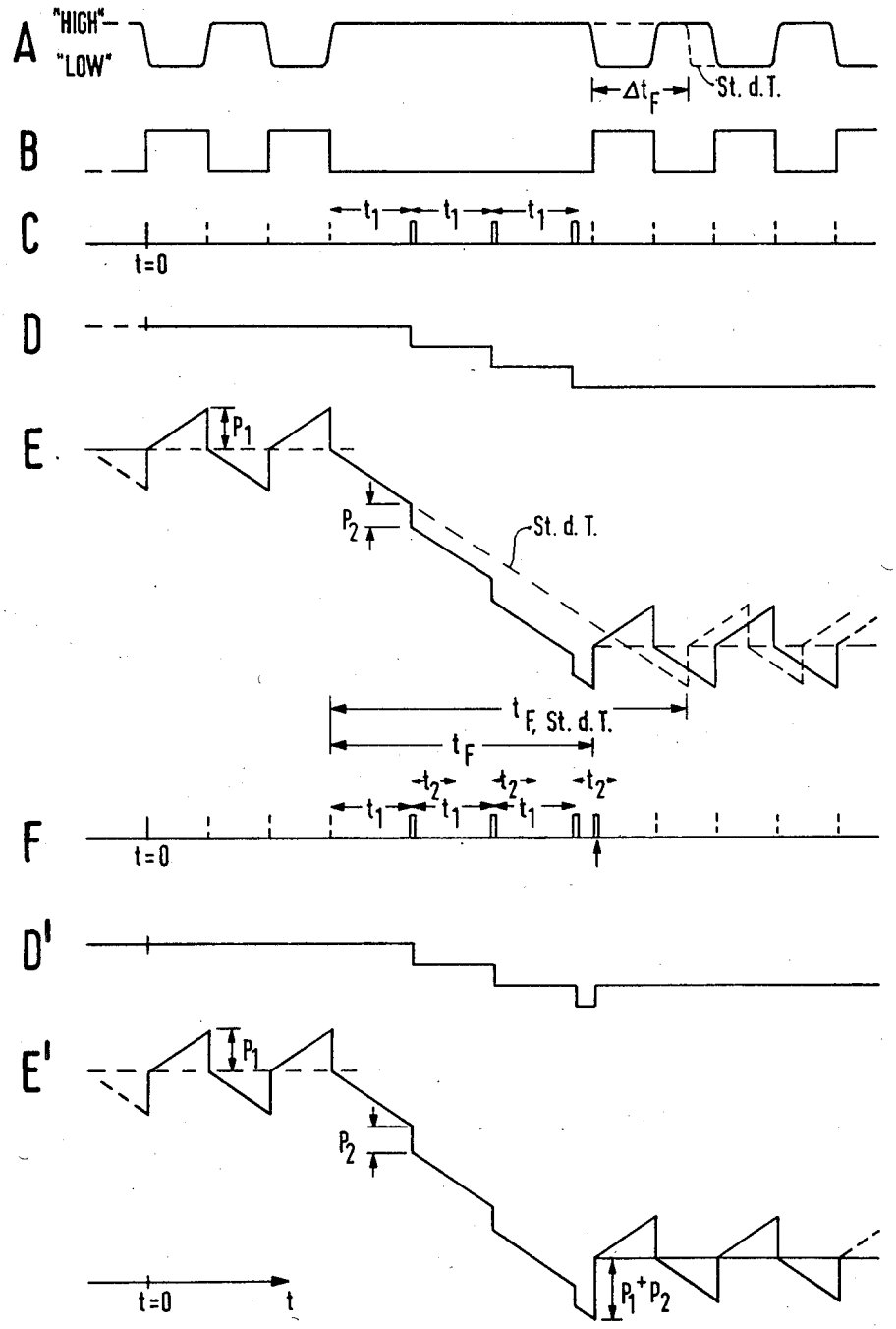
FIGS. 2A–E' illustrates in diagrams time behavior of signals occurring at different points in the exemplary embodiment of this invention in FIG. 1A.

The lambda signal A at the output of lamba probe 10, shown in the diagram A in FIG. 2, is applied to the comparator 14 which can be in the form a Schmitt trigger circuit for example so that at the output point B a signal according to the diagram B in FIG. 2 is generated, having steep flanks and sharp transitions between respective pulses. The clock pulse generator 20 is reset with each rising and falling edge of the signal B so that the resulting clock pulses indicated in diagram C in FIG. 2 delimit time intervals $t_1$ which are repeatedly started with each changeover or transition of the signal B. The time interval $t_1$ corresponds to a monotoring time interval. The pulse rate and the length of the monitoring time interval $t_1$ is dependent on and varies according to different operational parameters (Q, n, d, etc.) of the engine, applied to the generator 20. In any event, the monitoring time interval $t_1$ is always greater than the non-operational time of the entire regulating arrangement.

In the event that during a monitoring time interval $t_1$ the output signal B of the comparator 14 remains unchanged, the clock pulse generator 20 delivers a timing pulse (indicated in full line) which is applied to and counted by the counter 19. If however during the monitoring time interval $t_1$ a change-over of the output signal B of the comparator 14 occurs, then the clock pulse generator is reset to its zero position and no timing signal is generated. In FIG. 2C, the reset clock signals are indicated by dashed lines.

Assuming that switch 21 is closed and the resetting device 22 is short circuited, the counter 19 is supplied with the sequence of timing pulses C at the time intervals $t_1$. The counter 19 is preferrably designed as a forward/backward counter and the counting direction is determined by the level of the output signal B from the comparator 14. The analog voltage at the output of the digital/analog convertor 24 is shown in the time diagram in FIG. 2D. From this diagram it will be seen that for low level output signals B, the clock pulses from the clock pulse generator 20 are counted backwards while when the output signal at the comparator 14 attains high or positive values, the output signal D from the digital/analog convertor is increased in dependency on the rate of the sequence of timing pulses C. The count of the counter 19 is thus essentially a measure for the magnitude of the correction factor of the lambda regulation, that means for the deviation of a preset air-fuel ratio from a stochiometric value.

The output signals B of the comparator 14 are further applied to a lambda shifter 15 which delays the rectangular pulses in response to the flank steepness for example. By means of the lambda shifter it is made possible to adjust other conditions than the stochiometric value for determining the air-fuel ratio. In the integrator control circuit 16 there are alternately activated two current sources of opposite polarity in dependency on the output signal from the lambda shifter 15. For the moment it is assumed that the output signal B from the digital/analog convertor 24 has a constant value. In this case, at the output of amplifier 17 a signal E is generated which in the diagram of FIG. 2E is indicated by dashed lines. This signal E is utilized at least for influencing the correction of the fuel supply to the engine. The diagram illustrates particularly the transition or change-over between two load points for example and in which different correction values will result. Depending on the magnitude of the output signal from the lambda shifter 15 capacitor 26 at the output of the integrator control circuit 16 is loaded by one of the two current sources in the circuit 16. In the case of a signal change-over at the point B the second current source in the circuit 16 is activated and capacitor 26 is discharged. The jump between the charging and discharging process of the capacitor 26 is determined by the parallel connection of the capacitor 25 and resistor 27. In this example, this jump is illustrated by arrow $P_1$ in the diagram of FIG. 2E. It has been noted that the switching of the two current sources in the intergrator circuit 16 is controlled completely in dependency on different operational parameters of the internal combustion engine, such as for example the rotary speed n, load L, the amount of supplied air or fuel or the temperature of the engine.

The output signal of the signal processing unit 13 (output of amplifier 17) is indicated by full line in the time diagram of FIG. 2E. This control signal E at the output of the device of this invention deviates from the course of the signal E indicated by dashed line when the change-over time points of the signal A at the output of the lambda probe 10 exceed the monitoring time period $t_1$. In this case, a pulse is supplied by the clock pulse generator 20 which, as described before, causes at the output of the digital/analog convertor 24 a jump-like change of potential which in time is transmitted via the parallel RC member 25, 27 and the series connected capacitor 26 to the input of the amplifier 17.

The effect of this arrangement will become evident from the comparison of the time $t_F$ of the mismatch in the device of this invention (FIG. 2E) with time $t_F$, St.d.T of the mismatch in prior art devices. From this comparison the essential advantage of the method of this invention is readily perceivable, namely the time of mismatch $t_F$ is considerably shorter than that achievable by conventional methods.

The dashed line in FIG. 2A shows the change-over behavior of the output signal of lambda probe in prior art devices. It will be seen that the change-over point St.d.T of the signal in prior art devices would occur about a time difference $\Delta t_F$ later in comparison with the signal change-over from high to low in the method of this invention.

The heighth of the potential jump $P_2$ is determined by the sensitivity of the digital/analog convertor 24 and can be controlled by adjusting the sensitivity of the convertor. The output control signal E from the amplifier 17 controls the correction fuel injection times in the engine in such a manner that in the presence of a weak mixture ("low" signal) the fuel supply is increased whereas when rich mixture is detected ("high" signal) the fuel supply is reduced.

The provision of the resetting unit 22 indicated by dashed lines in FIG. 1A, has the following advantages:

If for example the lambda signal A changes after a relatively short time after the end of a monitoring time interval $t_1$, then retrospectively there is no need to produce the additional raising or lowering of potential at the output point D. In this case, the resetting device 22 is activated to neutralize the previous action, that means to reset the output signal D of the digital/analog convertor 24 to the previous value. For this purpose, by means of the first monostable multivibrator 28 an additional time interval $t_2$ is determined which preferably amounts to half of the time interval $t_1$ but in general can take also other values. The second monostable multivibrator 30 which is connected to the first multivibrator 28, has its enable or control input coupled to the output B of the comparator 14 so that during the time interval $t_2$ it reacts to the signal change-overs in the comparator 14. Hence if the clock pulse generator 20 generates a pulse the second monostable multivibrator 30 is activated during the time interval $t_2$. If during this time interval $t_2$ the signal A from the lambda probe changes from "high" to "low" or vice versa, then the second monostable multivibrator 30 generates in response to this voltage jump an additional output signal which is applied via the OR gate 29 to the input F of counter 19. By means of this voltage jump the preceeding clock pulse delivered by the generator 20 is always made a backward pulse inasmuch due to the jump of the lambda signal A at the output of the lambda probe the counting direction of the counter 19 is reversed. The time delay stage 23 serves for imparting a small time delay to the pulse sequence B so as to safeguard the change-over of the counting direction of the counter 19.

The corresponding pulse train F at the output of the resetting device 22 is illustrated in the diagram of FIG. 2F. In this detailed embodiment of the resetting device, the time interval $t_2$ has been selected to be one-half of the monitoring time interval $t_1$. According to the setting of the first monostable multivibrator 28, the time interval $t_2$ starts always after the expiration of the monitoring time interval $t_1$. In this example, only one change-over of the output signal from the oxygen probe 10 comes in the time interval $t_2$. The corresponding additional output pulse generated by the resetting device 22 is indicated in the diagram 2F by the vertical arrow. As a consequence, also the count at the counter 19 as well as the signal B' at the output of the digital/analog convertor 24 are changed accordingly.

The output voltage of the amplifier 17 indicated by E' is generated in cooperation with the resetting device 22 in an analogous manner and is illustrated in the diagram of FIG. 2E'. From the latter diagram it will be seen that after occurrence of the additional pulse the jump in the output voltage E' at the amplifier 17 has an amplitude $(P_1+P_2)$ and therefore it makes the preceeding jump $P_2$ a backward or downward jump.

The control circuit 18 is designed for inactivating the regulating arrangement in response to certain operational conditions of the engine, such as for example idling or full load operation and the like and switch-over to a control fuel mixture generation. In the latter case the counter 19 is fed by the control circuit 18 through a counting stage which depends on different operational parameters of the engine.

The device of this invention guarantees a very fast response of the regulating arrangement so as to obtain an optimum power output of the internal combustion engine at a minimum poluting exhaust gas emission.

The length of the additional monitoring time interval $t_2$ may of course be adjusted in dependency on the operational parameters of the engine or in dependency on the monitoring time interval $t_1$.

It will be understood that each of the elements described above or two or more together may also find a useful application in other types of constructions differing from the types described above. For example, the method of this invention can be with advantage carried out in a signal processing unit controlled by a microcomputer of a conventional design. In this case, namely when the function of the signal processing unit 13 and particularly the function of the integrator control circuit 16 is realizied by a correspondingly programmed microcomputer so that the integration is substituted by summation, then the counter 19 can directly control the integrator control circuit 16. For example, the output signal from the integrator control circuit 16 can be directly influenced by the counter 19 via conduit 32 and an arithmetic logic unit 33 by the counter 19 which in this case can be realized by the software of the microcomputer.

While the invention has been illustrated and described as embodied in a specific example of the method of and the device for regulating air-fuel ratio for an internal combustion engine, it is not intended to be limited to the details shown since various modifications and structural changes may be made without departing in any way from the spirit of the present invention.

Without further analysis the foregoing will so fully reveal the gist of the present invention that others can by applying current knowledge readily adapt if for various applications without omitting features that from the standpoint of prior art fairly constitute essential characteristics of the generic or specific aspects of this invention.

What is claimed as new and desired to be protected by Letters Patent is set forth in the appended claims:

1. A method of regulating air-fuel ratio in an internal combustion engine including a lambda probe for delivering a lambda signal indicative of proportion of oxygen in exhaust gas of the engine, and a signal processing unit connected to the lambda probe for processing the lambda signal according to an operational characteristic and delivering a control signal for an air-fuel ratio adjuster, the signal processing unit including means for adjusting between at least two changeovers of the lambda signal and after the expiration of an adjustable time period the operational characteristics of the signal processing unit in dependency on operational parameters of the engine such as load, rotary speed, and temperature, the method comprising the steps of comparing time intervals between consecutive change-overs of the lambda signal with successive monitoring time intervals $t_1$ during each of which the control signal has an increasing or decreasing course and, in the event of detecting an unchanged lambda signal after the expiration of a monitoring time interval $t_1$, discontinuing the course of the control signal at the end of each successive monitoring time interval the control signal and changing its magnitude in a jump to produce at the output of the signal processing unit a step-like course of the control signal until a change of the lambda signal is detected.

2. A method as defined in claim 1 wherein the monitoring time interval $t_1$ is adjustable in dependency on operational parameters of the engine.

3. A method as defined in claim 1 wherein the monitoring time interval $t_1$ equals at least to the non-operative time of the signal processing unit corresponding to the transit of the fuel mixture through the adjusting system of the engine.

4. A method as claimed in claim 1 wherein direction of said jump of the magnitude of the control signal is determined by a magnitude of said unchanged lambda signal.

5. A method as defined in claim 1 wherein the jump of the magnitude of the control signal at the output of the signal processing unit is reversed in direction when a change-over of the lambda signal occurs within another monitoring time interval $t_2$ following the first time interval $t_1$.

6. A method as defined in claim 5 wherein the additional time interval $t_2$ is set as a function of the first monitoring time interval $t_1$.

7. A method as defined in claim 5 wherein the additional time interval $t_2$ is set in dependency on different operational parameters of the engine.

8. A method as defined in claim 1 wherein the control signal at the output of the signal processing unit is applied for controlling the air-fuel ratio of the engine.

9. A device for regulating air-fuel ratio in an internal combustion engine including a lambda probe for delivering a lambda signal indicative of proportion of oxygen in exhaust gas, a signal processing unit connected to the lambda probe for processing the lambda signal according to an operational characteristic and delivering a control signal to an air-fuel ratio adjuster, the signal processing unit including means for adjusting between two change-overs of the lambda signal and after the expiration of an adjustable time interval the operational characteristic of the signal processing unit in dependency on operational parameters of the engine such as load, rotary speed, and temperature, comprising a pulse generator for generating timing pulses at a rate corresponding to a first monitoring time interval $t_1$, a counter having a counting input connected to the pulse generator, a setting input and an output; means coupled to the probe and to the setting input of the counter of suppress counting of said timing pulses when said change-overs occur and to start counting of said pulses when no change-over of the lambda signal from the probe has been detected after the expiration of the monitoring time interval $t_1$; and means for converting a count at the output of said counter into a stepped analog signal, said converting means being connected to the signal processing unit to generate at an output of the latter a stepped control signal for said air-fuel ratio adjuster.

10. A device as defined in claim 9 wherein the counter is a forward/backward counter and the direction of counting is determined by the potential of the lambda signal at the output of the lambda probe.

11. A device as defined in claim 10 wherein the output of the counter is coupled to the signal processing unit via a digital/analog convertor whose sensitivity determines the height of respective steps of the control signal at the output of the signal processing unit.

12. A device as defined in claim 11 further comprising a resetting unit selectively connectable between the pulse generator and the counting input of the counter, the resetting unit being activated after the expiration of the monitoring time interval $t_1$ for resetting the counter to its preceeding value when a change-over of the lambda signal takes place during an additional monitoring time interval $t_2$ following the first mentioned monitoring time interval $t_1$.

13. A device as defined in claim 12 wherein the additional monitoring time interval $t_2$ is adjustable in dependency on the first monitoring timing interval $t_1$.

14. A device as defined in claim 12 wherein the additional monitoring time interval $t_2$ is adjustable in dependency on different operational parameters of the engine.

15. A device as defined in claim 9 wherein the first monitoring time interval $t_1$ is adjustable in dependency on different operational parameters of the engine.

16. A device as defined in claim 11 further comprising a control unit connected to the signal processing unit and to a setting input of the counter for modifying the control signal at the output of the signal processing unit in dependency on different operational parameters of the engine such as on idling speed and full load operation.

17. A device as defined in claim 16 wherein the counter is preset to a predetermined count for controlling the air-fuel ratio of the engine by the control signal at the output of the signal processing unit.

* * * * *